United States Patent [19]

Powell

[11] 4,047,714

[45] Sept. 13, 1977

[54] PUSH PULL TYPE EXERCISING DEVICE

[76] Inventor: Truman W. Powell, P.O. Box 535, Zephrhills, Fla. 33599

[21] Appl. No.: 677,166

[22] Filed: Apr. 15, 1976

[51] Int. Cl.[2] ..... A63B 21/00

[52] U.S. Cl. ..... 272/116; 272/126

[58] Field of Search ..... 272/126, 135, 137, 136, 272/139, 142, 78, 133, 116

[56] References Cited

U.S. PATENT DOCUMENTS

| | | | |
|---|---|---|---|
| 763,475 | 6/1904 | Frazee et al. | 272/136 X |
| 3,677,543 | 7/1972 | Richardson | 272/136 |
| 3,843,119 | 10/1974 | Davis | 272/126 |
| 3,979,114 | 9/1976 | Codina | 272/126 |

FOREIGN PATENT DOCUMENTS

| | | | |
|---|---|---|---|
| 439,040 | 12/1967 | Switzerland | 272/136 |

*Primary Examiner*—Richard C. Pinkham
*Assistant Examiner*—William R. Browne
*Attorney, Agent, or Firm*—Imirie, Smiley & Guay

[57] ABSTRACT

Improved body exercising devices of the type having a pair of flexible lines, each including a loop in an end thereof for engagement by the hands or feet of one or more individuals. Each line passes over a pulley connected to a support assembly. The support assembly includes a length of flexible line, two intermediate portions of which are connected together to form a closed loop and a pair of depending legs to which the pulleys are attached. The hand and foot engaging loops are formed by self-locking knots and include a reinforcing cover member. The loose end of the knot may be either woven into the line itself or tucked into the end of the reinforcing member so as to avoid injury or discomfort to the user. The pulleys may also have camming shoulders such that a pair of pulleys attached to each other at their eyelets results in their assuming and maintaining a 15° to 30° angle with respect to each other; and a double loop support assembly serves to hold the pulleys firmly together when the apparatus is used by an individual and to allow the pulleys to be separated from each other when two or more individuals use the apparatus as a dual isometric exerciser.

8 Claims, 7 Drawing Figures

Fig. 3
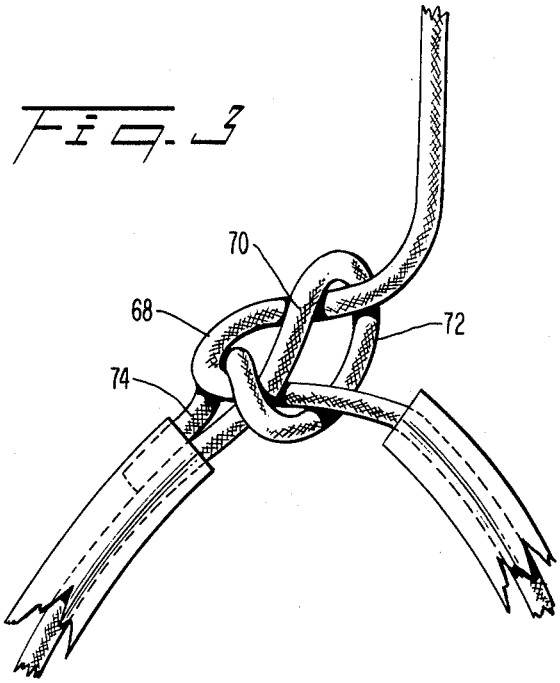
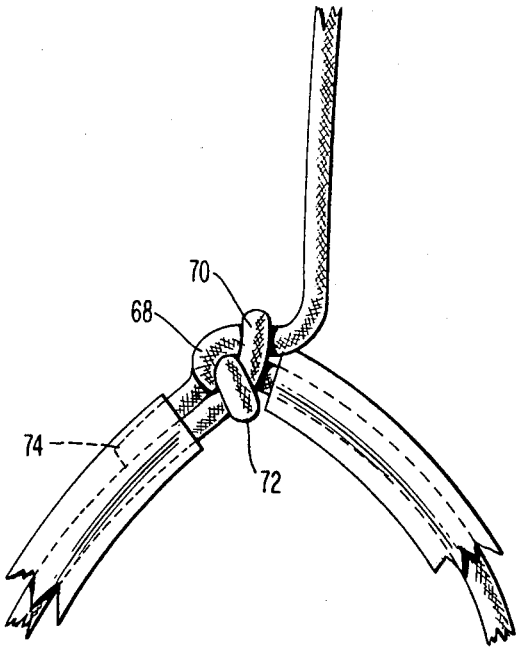
Fig. 4
Fig. 5
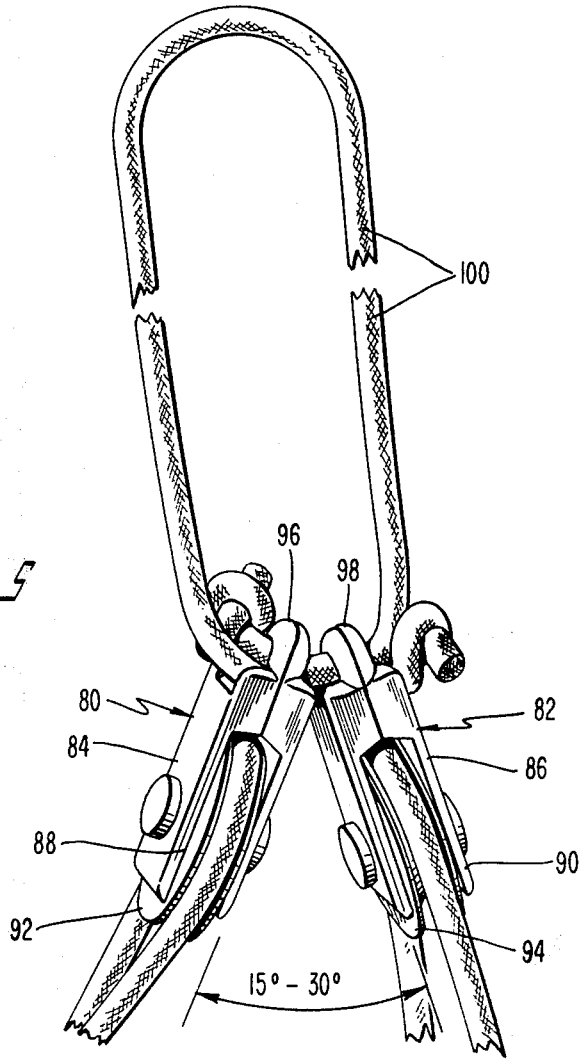

PUSH PULL TYPE EXERCISING DEVICE

BACKGROUND OF THE INVENTION

1. Field of the Invention

The present invention relates generally to exercising apparatus of the type having a pair of flexible lines to be manipulated by the coordinated movement of the hands and feet of an individual, and more particularly, to such exercising apparatus incorporating smooth knots, eliminating unnecessary component parts, and providing positive positioning of pulleys with respect to each other to promote enhanced operation.

2. Description of the Prior Art

Exercising devices using flexible lines and providing for the coordinated movement of the hands and feet of an individual are well known, as exemplified by U.S. Pat. No. 3,858,874. Such devices have received considerable commercial acceptance and have made it possible for persons to do considerable exercise in a unique and entertaining fashion and in a way which prevents tiring.

Known devices of this general type are made from a number of individual pieces which must be assembled together to form a single assembly. The number of individual parts results in considerable manufacturing costs, and the component parts adjacent the hand and foot loops often touch the user's skin causing discomfort and irritation. In addition to these disadvantages, additional disadvantages exist in the absence of any means to assure the proper positioning of the two pulleys relative to each other in the assembly without again requiring additional component parts.

The prior art has also failed to recognize that exercising can be promoted by providing for the simultaneous exercise of two or more individuals. In addition to being more enjoyable and entertaining, devices which promote the exercise of two or more persons acting against each other supplement the isometric muscle stimulation provided by exercisers usable only by one person and form the basis for a more well rounded program of overall muscle exercise.

SUMMARY OF THE INVENTION

It is, therefore, an object of the present invention to enable isometric exercise either individually or together with another person.

Another object of this invention is to construct an exercising assembly having no sharp edges or protruding portions which might otherwise cause user discomfort or irritation.

A further object of this invention is to positively position the pulleys of a flexible line exercising assembly in a predetermined position with respect to each other so as to enhance smooth operation of the apparatus in use.

The present invention is summarized as a flexible-line exercising device including hand and foot loops formed by self-tightening knots, the ends of which are woven or tucked into the loop assemblies. A unique pulley assembly promotes positive relative positioning between the pulleys, and, in an alternative embodiment, a bifurcated support loop assembly is provided.

This invention exhibits a number of advantages over the prior art in that the number of component parts is reduced, no sharp edges or protruding parts exist to irritate a user, and operation by an individual or a number of persons is facilitated while maintaining proper pulley positioning for smooth operation.

These and other objects and advantages of the present invention will become apparent from the following description of the preferred embodiments when taken in conjunction with the accompanying drawings.

BRIEF DESCRIPTION OF THE DRAWINGS

FIG. 3 is an exploded plan view of a self-locking knot which may be used to form the hand and foot loops of the apparatus of FIG. 1;

FIG. 4 is a detailed view similar to FIG. 3 but showing the knot tightening under tension;

FIG. 5 is a partial perspective view showing a second embodiment of the support loop and pulley assembly according to the present invention;

DESCRIPTION OF THE PREFERRED EMBODIMENTS

Figure 1:
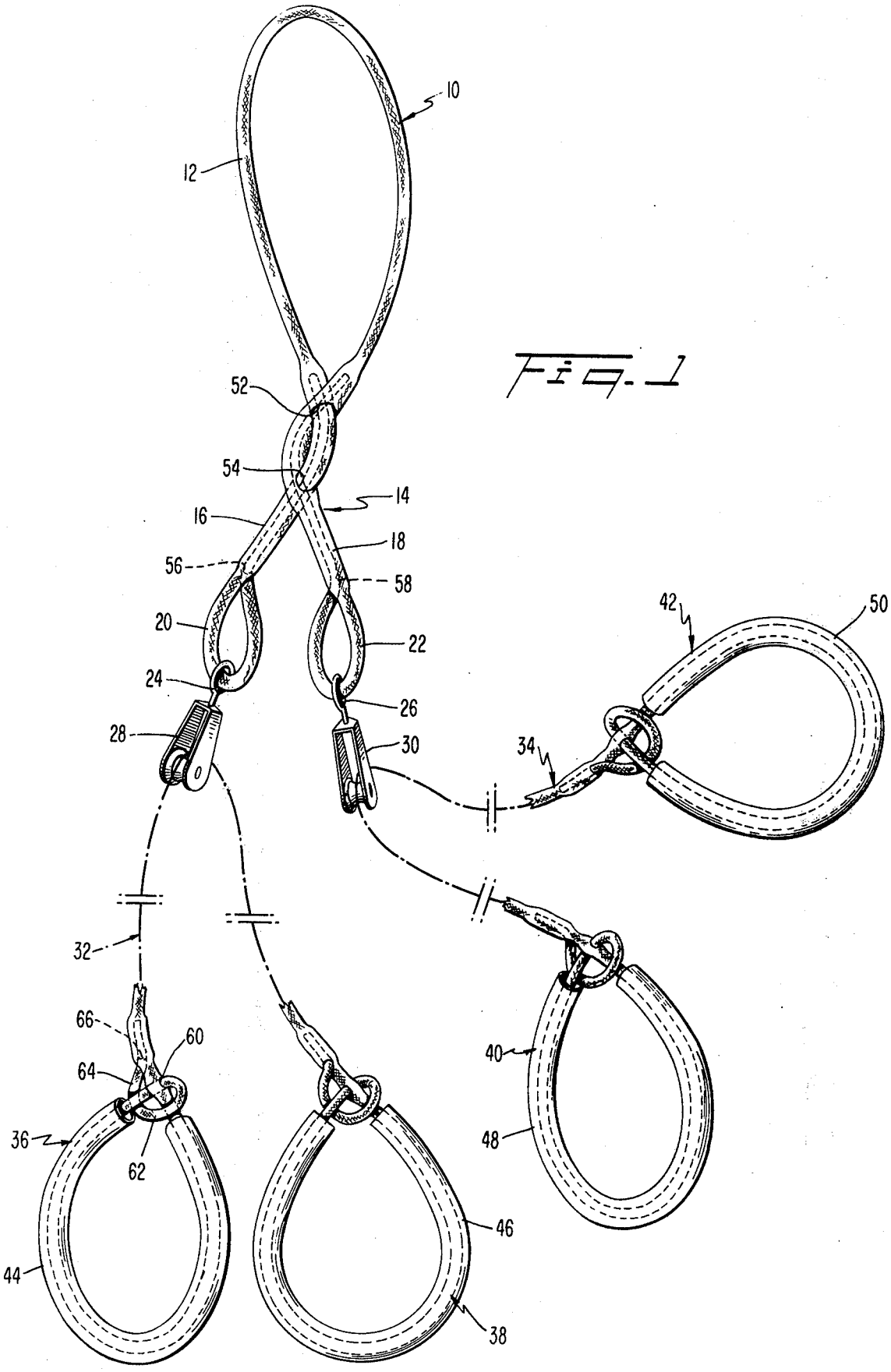
FIG. 1 is a perspective view of a preferred embodiment of an exercising apparatus according to the present invention.
Figure 2:
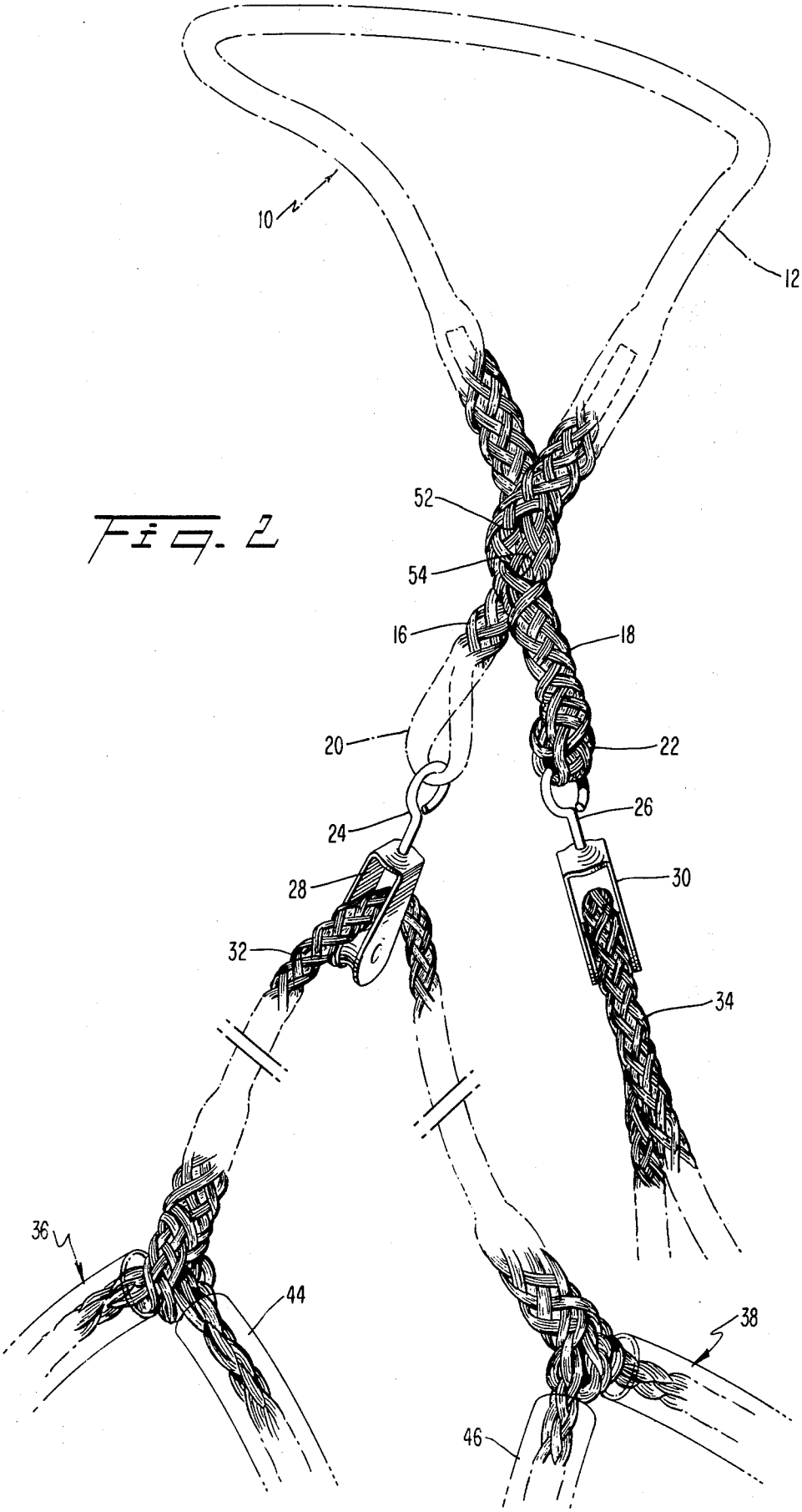
FIG. 2 is an exploded perspective view showing a detail of the apparatus of FIG. 1 constructed by using woven synthetic material.

A first embodiment of an exercising apparatus according to the present invention is illustrated in FIGS. 1 and 2 and includes a support loop 10 having an upper portion 12 forming a closed loop, and a bifurcated lower portion 14 having first and second legs 16 and 18. Two small loops 20 and 22 are formed at the ends of legs 16 and 18, respectively, to which the eyelets 24 and 26 of a pair of pulleys 28 and 30, respectively, are attached.

First and second flexible lines 32 and 34 are passed over pulleys 28 and 30, respectively, and have closed loops 36 and 38, and 40 and 42, respectively, formed in the ends thereof. Each of the terminal loops is identical and is preferably encased in a length of flexible plastic tubing 44, 46, 48 and 50.

Loop 12 of the support member 10 may be looped over a door knob or any other suitable fixed support. Preferably, support member 10 and flexible lines 32 and 34 are formed of a hollow, woven synthetic material such as nylon. In forming the support assembly 10, a length of such line is selected, and a pair of opening 52 and 54 are formed with a fid (not shown). The end of the line farthest from the openings 52 and 54 is then threaded first through opening 52 and then through opening 54 so as to form the closed loop 12 and the legs 16 and 18. Thereafter, the ends of the two legs 16 and 18 are threaded through the eyelets 24 and 26 of the pulleys 28 and 30 and are then threaded into the center of the woven lines through partial openings 56 and 58 formed with the lid.

Each of the loops 36, 38, 40 and 42 are formed in a similar manner. Initially, the plastic encasing sleeve is slipped over the end of the line and then the fid is used to make an opening 60 completely through the line adjacent the inner end of the sleeve as shown in connection with loop 36. The end of the line is then threaded through the opening 60, carried over the top of the line to form a loop portion 62, is threaded under itself to form a lower loop 64, and then is forced into the line itself through a partial opening 66 formed with the fid.

In the above manner, the exercising device may be made without the use of additional component pieces and requires only two pulleys, four lengths of plastic sleeving, and a suitable length of woven rope. The finished device has no projecting or sharp corners which might otherwise irritate or injure a person using the device and the finished product is aesthetically pleasing.

The above described embodiment may be made of any suitable rope in addition to woven nylon, such as dacron line, woven cotton rope or any other suitable material. In some cases, the tightness of the rope weave makes it difficult to form a knot of the type described and illustrated in FIGS. 1 and 2. As shown in FIGS. 3 and 4, an alternative know arrangement is provided according to the present invention for use in forming each of the loops 36, 38, 40 and 42. In forming the knot of FIGS. 3 and 4, the plastic encasing tube is first slipped onto the end of the line and a small loop 68 is formed adjacent the inner end of the sleeve. While holding this loop, the free end of the line is brought over the loop at portion 70, is continued around the bottom of the loop at portion 72 to form an encircling loop and then is fed up over portion 70 and down through loop 68. The end 74 is then tucked into the plastic sleeve and the knot is tightened as shown in FIG. 4. As can be appreciated, this particular knot is self-tightening since the greater the tension applied to the line, the greater the grasp of the end of the line 74 by loop 68.

In the embodiment of FIGS. 1 and 2, legs 16 and 18 of the support loop assembly allow the pulleys 28 and 30 to freely move in any direction and position themselves in any angle. In conducting many exercise programs, however, it has been found that a preferred positioning of the two pulleys is established when they are maintained at a 15° to 30° angle with respect to each other. Referring to FIG. 5, a pair of identical pulley assemblies 80 and 82 are illustrated each including a generally rectangular main body portion 84–86 defining a channel 88–90 which accommodates a pulley wheel 92–94 having a relatively deep peripheral channel for receiving the rope lines. At the end opposite the pulley wheels, support eyelets 96–98 are formed for receiving a support loop 100. Each of the ends of support loop 100 are fed through eylets 96 and 98 and are knotted as shown. When the support loop 100 is attached to a door knob or other fixed protrusion, and tension is applied to the lines, the knots in the ends of loop 100 are drawn toward each other so as to squeeze the eyelets 96 and 98 together. Eyelets 96 and 98 have a narrower dimension than the lateral dimension of the main body portion 84–86 of the pulley assemblies so as to define a pair of shoulders. In this manner, when the eyelets 96 and 98 are forced together, adjacent shoulder of the main body portions of the pulleys engage and cooperate with each other to form a fulcrum whereupon the pulley assemblies are cammed or biased apart and are held in the desired 15°–30° relationship.

The embodiments heretofore described are preferably used by an individual by engaging one of the loops of each line with a foot and the opposite loops of each line with a hand. By coordinated movement of the hands and feet, exercising programs may be carried out to strengthen and tone the muscles of the body. In this fashion, considerable exercise of many muscles can be accomplished without undue fatigue or strain thereby making exercise available to persons heretofore discouraged by prior art exercising assemblies.

In many instances, two or more individuals may wish to simultaneously exercise, and the exercising apparatus of the present invention may also be used under those circumstances. Referring to FIG. 1, for example, lines 32 and 34, respectively, may be used by two individuals acting against each other. Loops 36 and 38 may be held by the hands of the first user, while loops 40 and 42 are held by the second user, with both parties standing apart from each other by a sufficient distance to maintain tension in all of the lines. The support loop assembly 10 would not have to be attached to any fixed object, and could be left dangling between the users or could be used to support additional weights to enhance the isometric exercising effect produced by the respective movement of the two individuals.

Figures 6, 7:
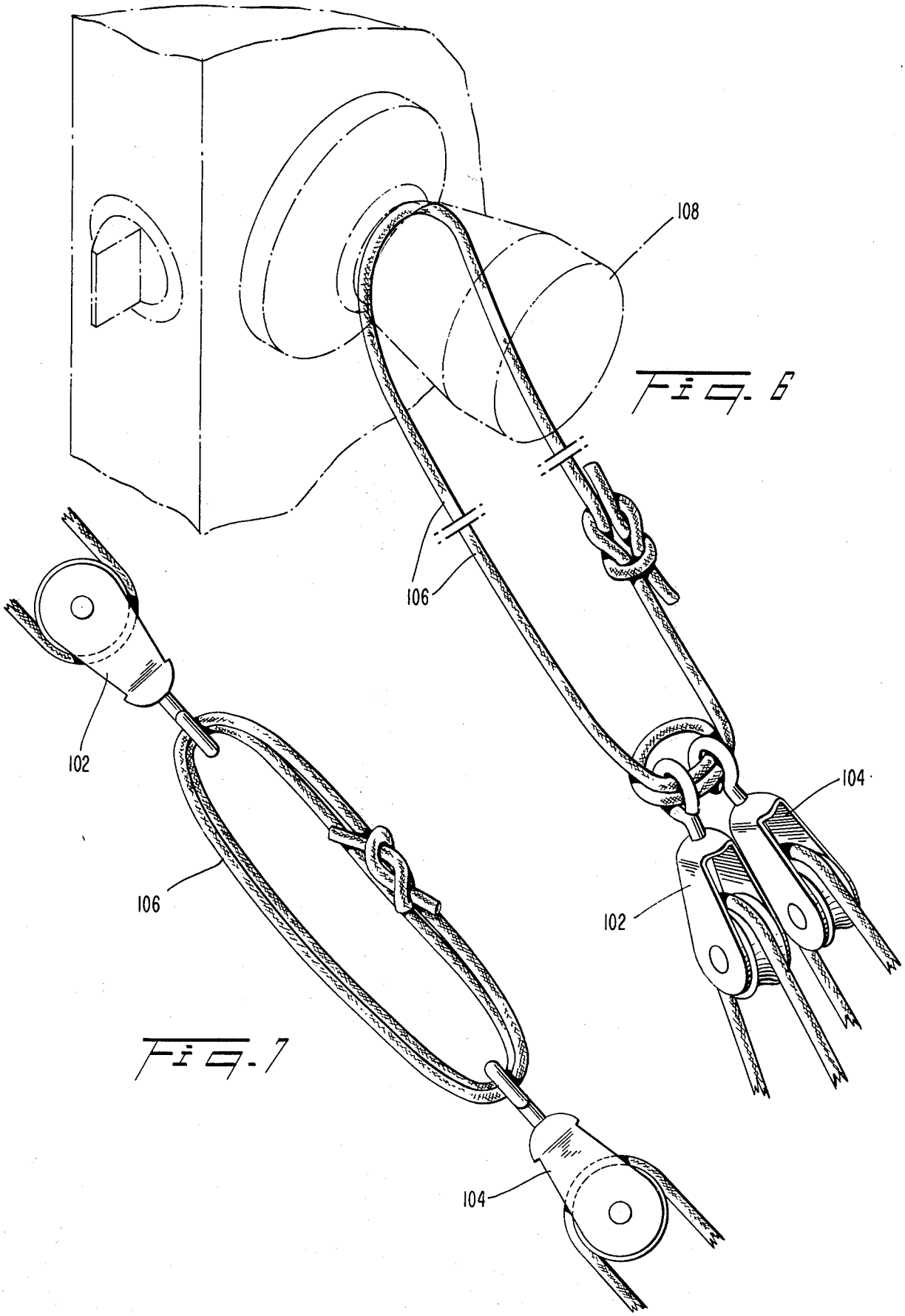
FIG. 6 is a partial perspective view showing another embodiment of the support loop and pulley assembly according to the present invention in a position for individual exercise.
FIG. 7 is a partial perspective view of the apparatus of FIG. 6 in a position for exercise by two individuals.

FIGS. 6 and 7 illustrate a further embodiment of the present invention specifically adapted for use as both an individual exerciser and as an exerciser for two persons. In such embodiment, two pulleys 102 and 104 for the two exercising lines are attached at their eyelets by a double-loop 106 of a single length of flexible line tied together at the ends by a knot. By passing line 106 through the eyelets twice, the assembly may be used as an individual exerciser, as shown in FIG. 6, or as an exerciser for two individuals, as shown in FIG. 7. When used as an individual exerciser, one of the double support loops is attached to a door knob 108 whereupon tension in the lines causes the other loop to tighten about the eyelets of the pulleys so as to hold them firmly together in the desired position. When used as an exerciser for two or more individuals, as shown in FIG. 7, the two pulleys are manually pulled apart whereupon the double-loop 106 is pulled out and holds the pulleys relatively close to each other. It can be seen that any suitable pulley may be employed with the embodiment of FIGS. 6 and 7, such as the pulleys illustrated in FIGS. 1 and 2 or the pulleys of FIG. 5.

As can be appreciated from the foregoing, the present invention enables the unique exercising of many body muscles by the coordinated movement of hands and feet of either an individual or two or more persons. The present invention has few parts, has no protruding or sharp edges, provides for proper pulley positioning and is readily converted from individual to tandum use. It should also be appreciated that the device can be used by an individual by engaging both legs and both hands with the four loops to perform a first series of exercises, or a single line can be engaged by the hands only or feet only to perform a second series of exercising movements, as desired.

Inasmuch as the present invention is subject to many variations, modifications and changes in detail, it is intended that all matter contained in the foregoing description or shown in the accompanying drawing shall be interpreted as illustrative and not in a limiting sense.

What is claimed is:

1. In an exercising apparatus of the type having a pair of flexible lines each terminating at each end in a loop for engagement by the hands or feet of a user, a support assembly for attachment to a fixed support, and pulley means connected to said support assembly, said flexible lines passing over said pulley means whereby said flexible lines may be tensioned by the user and reciprocated over said pulley means in the performance of exercises, the improvement wherein said pulley means comprises a pair of pulleys, each supporting one of said flexible lines and having a main body portion and an integral eyelet portion, and a pulley wheel freely rotatable in said main body portion, said main body portion having a shoulder on each side of the plane of said eyelet portion, said support assembly including a support line passing through said eyelet portions of said pair of pulleys, said eyelet portions being held in direct physical engagement with each other by said support line, and adjacent shoulders of each of said pulleys cooperating with each other to form a fulcrum for biasing the ends of said main body portions opposite said eyelet portions away from each other so as to establish and maintain said pair of pulleys at an angle of about 15°–30° in use.

2. The apparatus as recited in claim 1 wherein said main body portion, said eyelet portion, and said pulley wheel are formed of molded plastic material.

3. In an exercising apparatus of the type having a pair of flexible lines each terminating at each end in a loop for engagement by the hands or feet of a user, a support assembly for attachment to a fixed support, and a pair of pulleys connected to said support assembly, said flexible lines passing over said pulleys whereby said flexible lines may be tensioned by the user and reciprocated over said pulleys in thhe performance of exercises, the improvement wherein said support assembly comprises loop means including a single, unbroken length of flexible line one end of which passing through each of said pulleys in one direction and being knotted adjacent one of said pulleys and the other end passing through each of said pulleys in the opposite direction and being knotted adjacent the other of said pulleys, said loop means supporting and drawing said pulleys together, by the cooperative action of said knots, when said line is placed in tension.

4. In an exercising apparatus of the type having a pair of flexible lines each terminating at each end in a loop for engagement by the hands or feet of a user, a support assembly for attachment to a fixed support, and a pair of pulleys connected to said support assembly, said flexible lines passing over said pulleys whereby said flexible lines may be tensioned by the user and reciprocated over said pulleys in the performance of exercises, the improvement wherein said support assembly comprises a single length of flexible line passing twice through each of said pulleys to form a support loop, the ends of said single length of line being knotted together to form a double loop whereby each loop has substantially the same dimension when the pulleys are pulled apart from each other for exercise by two persons and whereby one loop has a much larger dimension than the other when the pulleys are placed together for exercise by one person, tension in the larger loop causing the smaller loop to tightly hold the pulleys together when the larger loop is attached to a fixed support.

5. In an exercising apparatus of the type having a pair of flexible lines each terminating at each end in a loop for engagement by the hands or feet of a user, a support assembly for attachment to a fixed support, and a pair of pulleys connected to said support assembly, said flexible lines passing over said pulleys whereby said flexible lines may be tensioned by the user and reciprocated over said pulleys in the performance of exercises, the improvement wherein said support assembly comprises a length of flexible line two intermediate portions of which are connected together to form a closed loop and a pair of depending legs, each of said pair of pulleys being connected to an end of a respective one of said legs.

6. The apparatus as recited in claim 5 wherein one of said intermediate portions is defined by a pair of spaced holes through said line and wherein the other intermediate portion passes through both of said holes.

7. The invention as recited in claim 6 wherein said line of said support assembly is a hollow, woven plastic material, and wherein the end of each of said depending legs is folded back upon itself to form a pulley-supporting loop and passes into the hollow core of said line through a hole in the wall thereof.

8. The invention as recited in claim 7 wherein said pair of flexible lines comprise lengths of hollow, woven plastic material, and wherein the loops in the ends of said pair of flexible lines are encased in a flexible plastic cover, each end of each said line passing completely through a hole in said line adjacent the inner end of said cover, continuing around through the center of the loop, and passing into the hollow core of said flexible line through a hole in a wall thereof adjacent said loop.

* * * * *